US009519252B2

(12) United States Patent
Tateishi et al.

(10) Patent No.: US 9,519,252 B2
(45) Date of Patent: Dec. 13, 2016

(54) FIXING DEVICE

(71) Applicant: CANON KABUSHIKI KAISHA, Tokyo (JP)

(72) Inventors: Tomoya Tateishi, Kamakura (JP); Masafumi Maeda, Yokohama (JP); Takashi Narahara, Mishima (JP); Toru Imaizumi, Kawasaki (JP); Yasuhito Minamishima, Osawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/962,104

(22) Filed: Dec. 8, 2015

(65) Prior Publication Data

US 2016/0170338 A1 Jun. 16, 2016

(30) Foreign Application Priority Data

Dec. 10, 2014 (JP) ..... 2014-250413

(51) Int. Cl.
*G03G 15/20* (2006.01)

(52) U.S. Cl.
CPC ..... *G03G 15/206* (2013.01)

(58) Field of Classification Search
None
See application file for complete search history.

(56) References Cited

U.S. PATENT DOCUMENTS

2002/0071700 A1* 6/2002 Nishitani ..... G03G 15/2039 399/328

FOREIGN PATENT DOCUMENTS

| | | | |
|---|---|---|---|
| JP | 03264976 A | * | 11/1991 |
| JP | 2002267543 A | | 9/2002 |
| JP | 2003271006 A | | 9/2003 |
| JP | 4777035 B2 | | 9/2011 |

* cited by examiner

*Primary Examiner* — David Gray
*Assistant Examiner* — Thomas Giampaolo, II
(74) *Attorney, Agent, or Firm* — Canon U.S.A. Inc., IP Division

(57) ABSTRACT

In a fixing device according to an exemplary embodiment of the present invention, a projection portion projected in a direction opposite to a direction biased by the biasing member, from a body part of the biasing member, is provided in a biasing member configured to push a thermosensitive member which receives heat from a heater, toward the heater, so that a crack in the heater at the time of an abnormal temperature rise is prevented.

6 Claims, 8 Drawing Sheets

FIXING DEVICE

BACKGROUND OF THE INVENTION

Field of the Invention

An exemplary embodiment of the present invention relates to a fixing device which is mounted in an image forming device such as a copying machine or a printer and which fixes an unfixed image, which is formed on a recording material, to the recording material.

Description of the Related Art

As a fixing device mounted in an electrophotography-type copying machine or printer, a film heating-type is known. A film heating-type fixing device includes a tubular film, a heater in contact with an inner surface of the film, and a pressure roller which forms a nip portion with the heater across the film. The heater is held by a heater holder made from resin. The heater holder is reinforced by a reinforcing member made from metal. A through-hole is provided in the heater holder and a temperature detection element provided in a space between the heater holder and the reinforcing member detects a temperature of the heater through the through-hole in the heater holder. The heater is controlled according to a temperature detected by the temperature detection element. In the space between the heater holder and the reinforcing member, a protection element such as a thermo switch is provided. The protection element also senses heat of the heater through a different through-hole provided in the heater holder. When the heater reaches an excessive temperature, the protection element interrupts power feeding to the heater. The temperature detection element may also have a function to interrupt power feeding to the heater when the heater reaches an excessive temperature.

When a device is designed, it is necessary to consider a case where power-feeding to a heater cannot be controlled. When a state in which the power-feeding to the heater cannot be controlled lasts in a film heating-type fixing device, a heater holder becomes softened due to heat. When the heater holder becomes softened, a load on the heater becomes uneven and the heater deflects and cracks. The protection element is provided to prevent such a condition. However, it takes a certain amount of time until the protection element is activated because of an influence of heat capacity of the protection element, so that the heater may crack before the protection element is activated.

Japanese Patent No. 4777035 discusses a technique for making a period of time (margin) until a fixing device becomes cracked longer, by exercising ingenuity in a shape of a heater holding surface of a heater holder. This is an idea to prevent the heater crack until the protection element is activated, by reducing stress applied to the heater when control cannot be performed and by earning time until the heater is cracked.

However, there is a case where enough time until the heater is cracked cannot be earned only by exercising ingenuity in a shape of the heater holder.

SUMMARY OF THE INVENTION

The present invention is directed to providing another method for earning time until the heater is cracked.

According to another aspect of the present invention, a fixing device is provided, which includes an elongated heater, a holder formed from a thermoplastic resin which holds the heater in a longitudinal direction of the heater, a reinforcing member which is in contact with the holder in the longitudinal direction and which reinforces the holder, a thermosensitive member which is provided in a space between the holder and the reinforcing member and which receives heat of the heater through a through-hole provided in the holder, and a biasing member which biases the thermosensitive member toward the heater, wherein the biasing member includes a projection portion which is not in contact with the reinforcing member and which is projected in a direction opposite to a direction biased by the biasing member from a body part of the biasing member.

Further features of the present invention will become apparent from the following description of exemplary embodiments with reference to the attached drawings.

DESCRIPTION OF THE EMBODIMENTS

Figure 1:
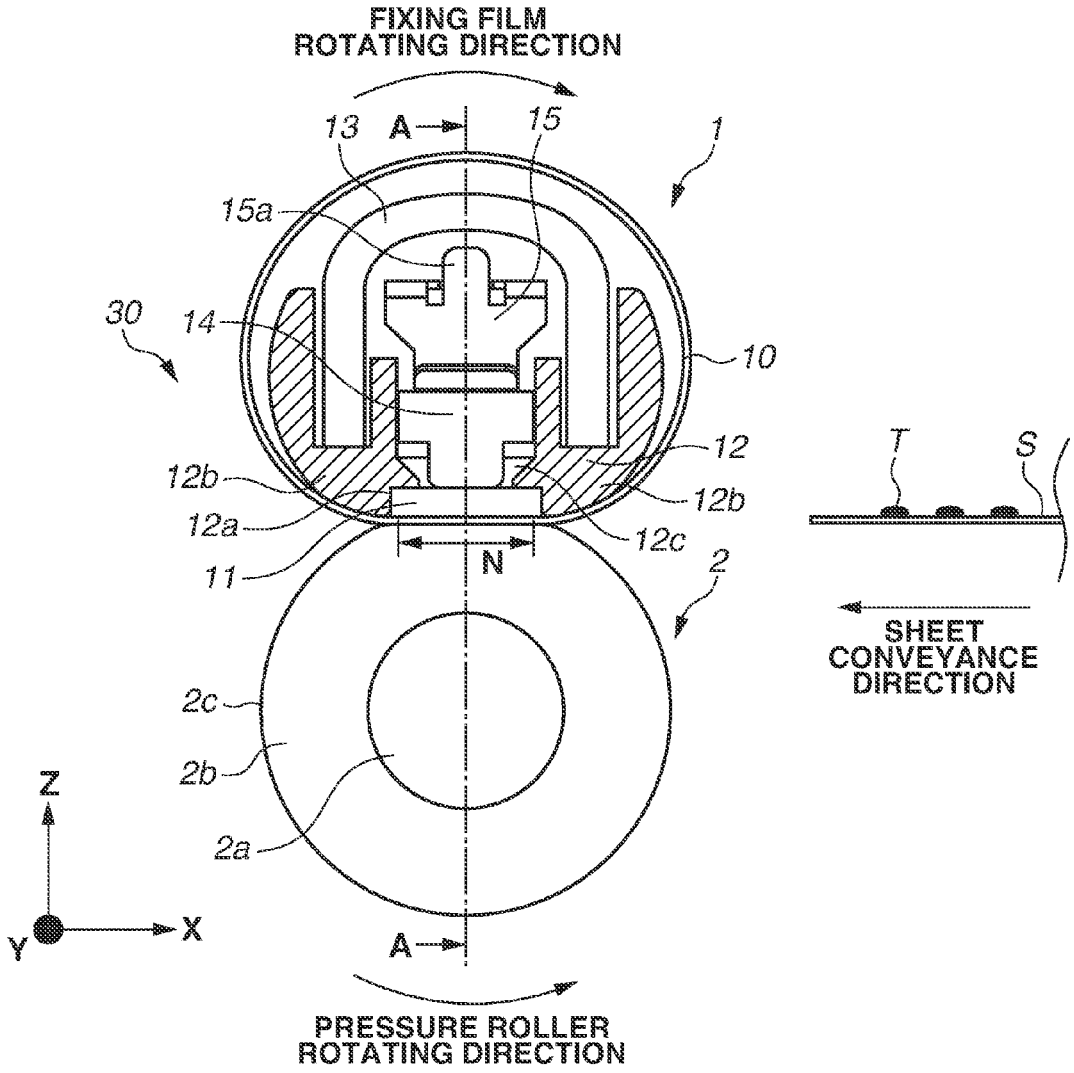
FIG. 1 is a sectional view of a fixing device of a first exemplary embodiment.
Figure 2:
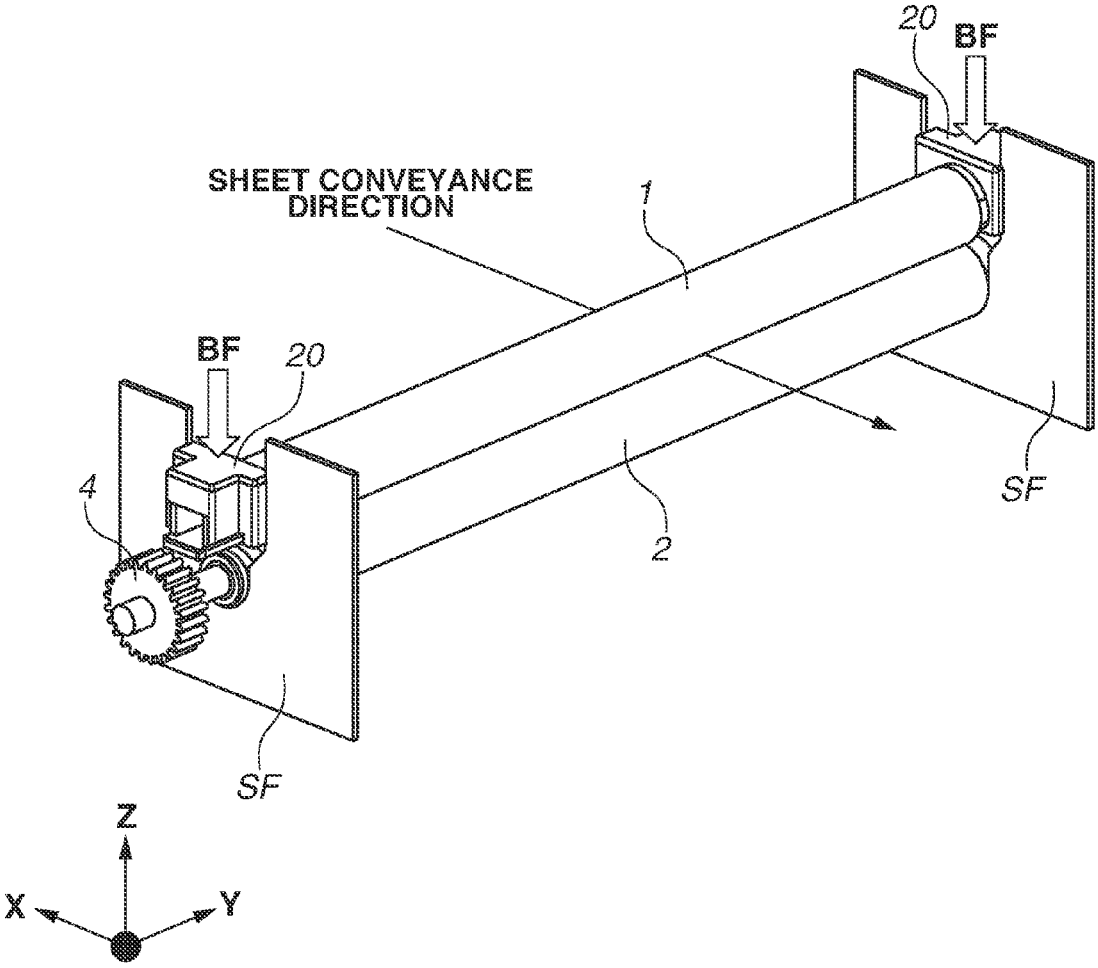
FIG. 2 is a perspective view of the fixing device of the first exemplary embodiment.

FIG. 1 is a sectional view of a fixing device 30 of a first exemplary embodiment. FIG. 2 is a perspective view of the fixing device 30. The fixing device 30 of the present example is a film heating-type fixing device. The fixing device 30 includes a film unit 1 and a pressure roller 2. The film unit 1 includes a tubular film 10, a heater 11, a heater holder 12, a stay (reinforcing member) 13, and a thermistor unit (thermosensitive member) 14. The film 10 is roughly fitted around the holder 12 and the stay 13. The film 10 includes a base layer formed from a resin material such as polyimide or PEEK or a metal material such as stainless steel or nickel, and a surface layer (release layer) which is made, for example, from a fluororesin and which has high releasability. The heater 11 is a ceramic heater in which a heat generating resistor is formed on a ceramic substrate. The heater 11 is a member elongated in a direction orthogonal to a recording material conveyance direction. The holder 12 is a member which is formed from a thermoplastic resin and which holds the heater 11 in a longitudinal direction of the heater 11. A material of the holder of the present example is a liquid crystal polymer (LCP). Here, a groove 12*a* in the holder 12 is configured to hold the heater and is formed in a Y-axis direction. Also a guiding surface 12*b* is provided on the holder 12 to guide a rotation of a film. The stay 13 is a reinforcing member, which is in contact with the holder 12 in a longitudinal direction and which reinforces the holder 12, a material thereof being metal (galvanized steel sheet (iron) in present example). With the stay 13, stiffness of the film unit 1 is secured. As illustrated in FIG. 1, the stay 13 is folded in such a manner that a sectional face becomes U-shaped. As illustrated in FIG. 2, a regulating member 20 to regulate movement of the film 10 in a generatrix direction of the film 10 is provided at both ends in the longitudinal direction of the stay 13.

The pressure roller 2 includes a cored bar 2*a* including iron, aluminum, or the like, a silicone rubber layer 2*b*, a release layer 2*c* including a fluororesin or the like, and a gear 4 attached to an end part of the cored bar 2*a*. The pressure roller 2 is rotatably held by a frame SF of the fixing device. The film unit 1 is attached, over the pressure roller 2, to the frame SF and a load indicated by an arrow BF is applied from a part on the regulating member 20. The load BF is applied in order of the regulating member 20, the stay 13, the holder 12, the heater 11, the film 10, and the pressure roller 2. Accordingly, a fixing nip portion N is formed between the film 10 and the pressure roller 2. When power of a motor (not illustrated) is transmitted to the gear 4, the pressure roller 2 is rotated and the film 10 is rotated along with the rotation of the pressure roller 2. A recording material S on which a toner image (unfixed image) T is formed is conveyed by the fixing nip portion N and the unfixed image is thermally-fixed to the recording material by heat of the heater 11.

The thermistor unit 14 to detect a temperature of the heater 11 is provided in a space between the holder 12 and the stay 13 and receives the heat of the heater 11 through the through-hole 12*c* provided in the holder 12. More specifically, the thermistor unit 14 is inserted into the through-hole 12*c* provided in the holder 12 and is in contact with the heater 11.

Figure 5A:
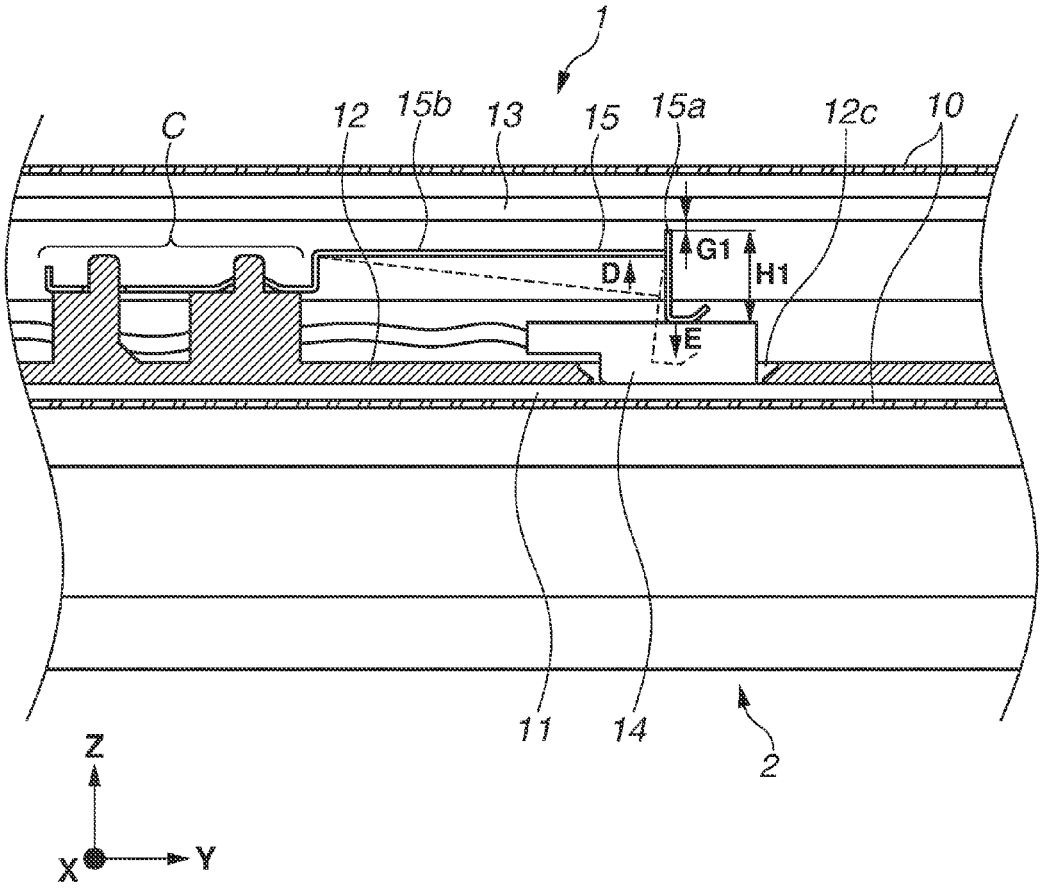
FIGS. 5A and 5B are sectional views illustrating a configuration in a vicinity of a thermistor.
Figure 5B:
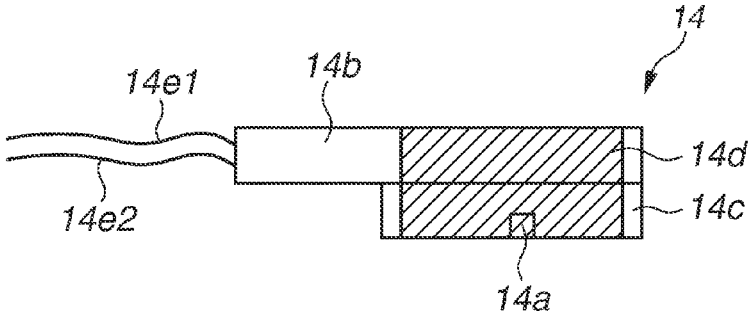

As illustrated in FIG. 5B, the thermistor unit 14 includes a pedestal portion 14*b*, an elastic portion 14*c* held by the pedestal portion 14*b*, a thermistor (temperature detection element) 14*a* held by the elastic portion 14*c*, and an insulating sheet 14*d* wound therearound. A material of the pedestal portion 14*b* is LCP. The elastic portion 14*c* has an insulation property and is formed by lamination of ceramic sheets. A material of the insulating sheet 14*d* is polyimide. To the thermistor 14*a*, two cables 14*e*1 and 14*e*2 are electrically connected. The thermistor 14*a* detects a temperature of the heater 11 through the insulating sheet 14*d*.

Figure 3:
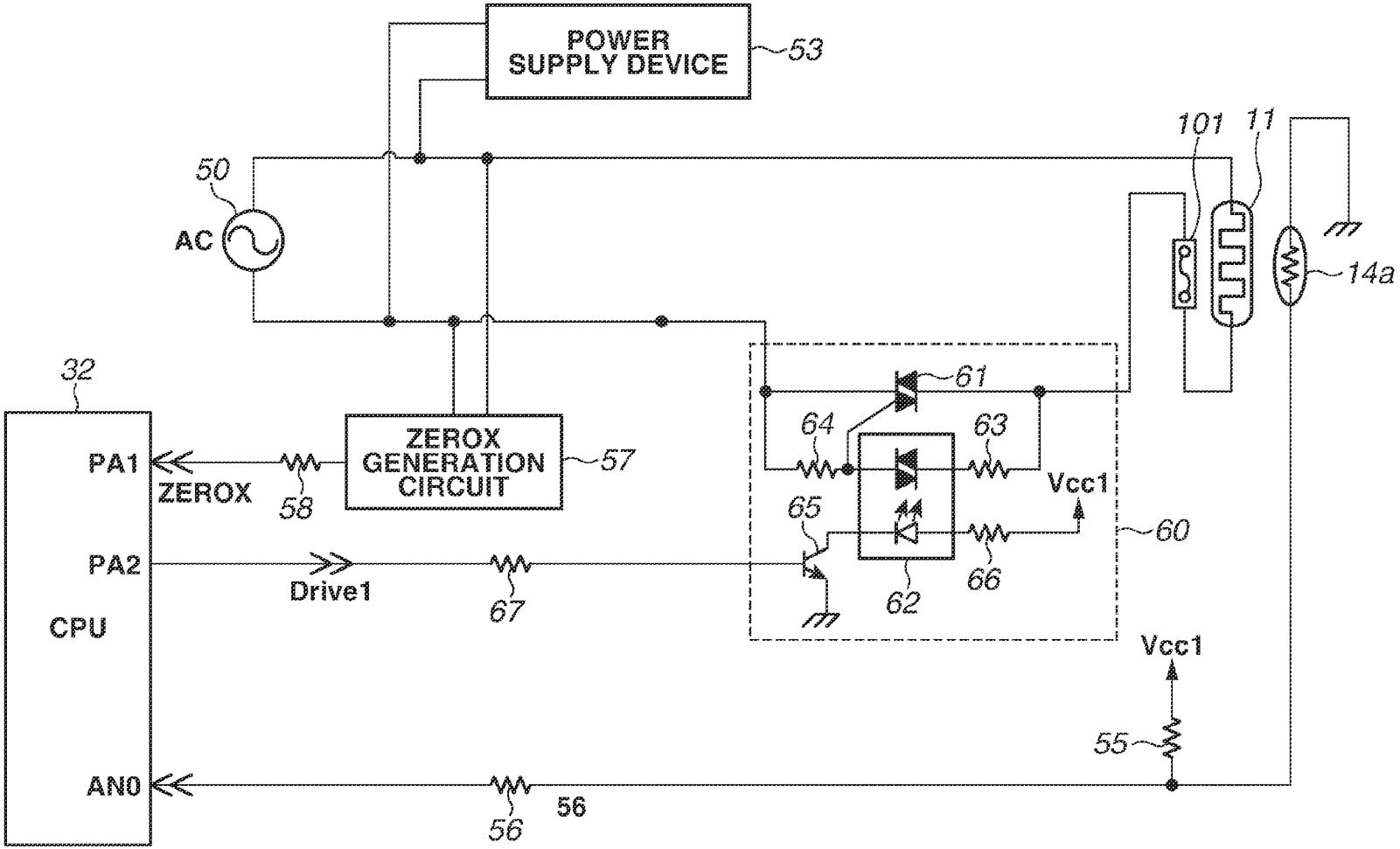
FIG. 3 is a heater driving circuit diagram.

FIG. 3 is a driving circuit diagram of the heater 11. Here, 50 is a commercial power supply (AC power supply). Power is supplied from the commercial power supply 50 to an image forming device in which the fixing device of the present example is mounted. A power supply device 53 (power supply unit) outputs a predetermined voltage (voltage 24 V and voltage Vcc1=3.3 V) to a load such as a motor or a control circuit in the image forming device. The power from the commercial power supply 50 is also supplied to the heater 11. A CPU 32 controls power supplied to the heater, and a heater driving circuit 60 is controlled according to a Drivel signal from the CPU 32.

The temperature of the heater 11 is monitored by the thermistor 14*a*. The thermistor 14*a* is an element to detect a temperature of the heater in a region through which a recording material having a minimum usable size passes in the image forming device (area Amin illustrated in FIG. 4). One terminal of the thermistor 14*a* is connected to the ground and the other terminal is connected to a resistor 55 and to an analog input port AN0 of the CPU 32 through a resistor 56. At a high temperature, a resistance value of the thermistor 14*a* is decreased. In the CPU 32, a temperature table (not illustrated) is stored and the CPU 32 detects a temperature of the heater 11 based on a divided voltage in a resistor of the thermistor and a fixed resistor 55.

A ZEROX generating circuit 57 is configured to detect and output zero crossing of a voltage of the commercial power supply 50. When a commercial power supply voltage is equal to or lower than a threshold voltage set around 0 V, the ZEROX generating circuit 57 outputs a High level signal. In other cases, the ZEROX generating circuit 57 outputs a Low level signal. Then, to a port PA1 of the CPU 32, a pulse signal with a cycle substantially identical to a cycle of the commercial power supply voltage is input through a resistor 58. The CPU 32 detects an edge, at which the ZEROX signal changes from High to Low, and uses this edge as a driving reference (reference timing) of a heater driving circuit 60.

The CPU 32 determines a duty cycle of power supplied to the heater 11 based on a temperature detected by the thermistor 14*a*. Then, the heater driving circuit 60 outputs a driving signal Drivel from a port PA2 in such a manner that driving in the determined duty cycle is performed.

Next, the heater driving circuit 60 will be described. When the output port PA2 becomes the High level at the timing determined by the CPU 32, a transistor 65 is turned on through a base resistor 67. When the transistor 65 is turned on, a photo-triac coupler 62 is turned on. A resistor 66 is a resistor to limit current which flows in a light-emitting diode in the photo-triac coupler 62. Resistors 63 and 64 are bias resistors for a triac 61. When the photo-triac coupler 62 is turned on, the triac 61 is turned on. Once being turned on, the triac 61 keeps the on-state until an AC current reaches a next zero crossing point. Thus, power according to on-timing is supplied to the heater 11.

Here, a thermal fuse 101 serves as a protection element. The thermal fuse 101 is provided in a power supply path to the heater 11. When the heater 11 generates heat abnormally, the thermal fuse 101 is blown. Thus, power supplied from the power supply 50 to the heater 11 is blocked. Similar to the thermistor unit 14, the thermal fuse 101 is provided in the space between the holder 12 and the stay 13 inside the film 10. Then, the thermal fuse 101 is inserted into a through-hole (not illustrated) provided in the holder 12 and is brought in contact with the heater 11. Also, similar to the thermistor unit 14, the thermal fuse 101 is arranged in the area Amin illustrated in FIG. 4 (thermal fuse 101 is indicated by a broken line in FIG. 4).

Figure 4:
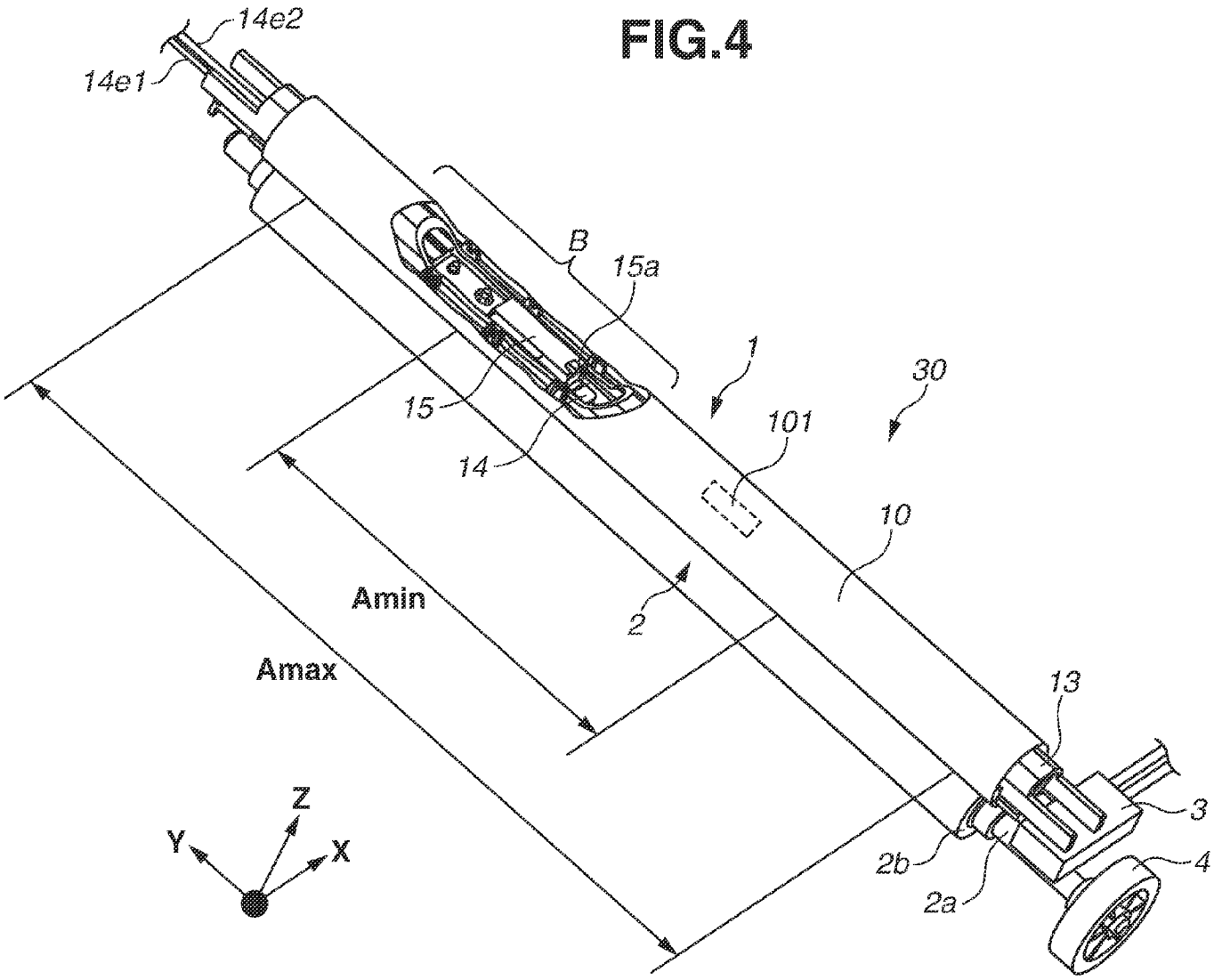
FIG. 4 is a perspective view of the fixing device of the first exemplary embodiment.

FIG. 4 is a perspective view of the fixing device 30 in which the film 10 and the stay 13 are cutout in a part B near the thermistor unit 14, and an inner part is visualized. In FIG. 4, the regulating member 20 and the frame SF illustrated in FIG. 2 are omitted. A connector 3 is configured to supply power from the power supply 50 to the heater 11. Amax indicates a region through which a recording material having the maximum usable size passes in the image forming device.

Next, a configuration in a vicinity of the thermistor unit 14 will be described with reference to FIG. 5A. FIG. 5A is an A-A sectional view in FIG. 1. A spring 15 (biasing member) is configured to push the thermistor unit 14 toward the heater 11. The biasing member in the present example is a plate spring made from a stainless thin plate. The spring 15 is fixed to the holder 12 at a C part in FIG. 5A. When the spring 15 is displaced from a free state indicated by a dashed line in FIG. 5A in a direction of an arrow D, the spring 15 pushes the thermistor unit 14 in a direction toward the heater 11 (direction of arrow E). The spring 15 includes a projection portion (regulating member) 15*a* which is not in contact with the stay 13. The projection portion 15*a* is projected in a direction opposite to a direction E pushed by the spring 15, from a body part (a part substantially parallel to the heater 11) 15*b* of the spring. The projection portion 15*a* is formed by folding a part of the spring 15. The projection portion 15*a* is not in contact with the stay 13 when a device is normally operating. When the heater 11 generates abnormal heat and the holder 12 becomes softened, the heater 11 is deflected and the thermistor unit 14 is pushed by the heater 11. Accordingly, the spring 15 is pushed in the direction of the arrow D by the thermistor unit 14. Then, the projection portion 15*a* comes to be in contact with the stay 13, to regulate a movement of the thermistor unit 14, and regulates deflection of the heater 11. When a device is normally operating, a gap G1 is provided between the projection portion 15*a* and the stay 13. If a variation in a component size or the like is considered, the gap G1 should be desirably reduced as much as possible within a range in which the projection portion 15*a* and the stay 13 are not in contact with each other. In the present example, the gap G1 is set as 0.8 mm. Thus, a range of motion of the thermistor unit 14 is 0.8 mm. The gap G1 can be desirably in a range of 0.5 to 1.0 mm.

A test to forcibly raise a temperature of the heater 11 to an abnormal level was conducted to check a behavior of the fixing device 30 according to the present example when the temperature abnormally rises. When the triac 61 is continuously driven in a duty cycle 100%, a highest thermal stress is applied to the heater 11 in the abnormal temperature rise. Thus, a test circuit was produced, simulating double troubles in which there are electrical shortings in the triac 61 illustrated in FIG. 3 as well as in a relay (not illustrated) provided in the power supply path to the heater 11. By using this circuit, a test to continuously supply power with voltage 120 V and a duty cycle 100% to the heater 11 was conducted to measure a period of time from a start of power-feeding until occurrence of a heater crack (heater-crack-time). The thermal fuse 101 abutted on the heater 11 but was connected to a circuit different from the test circuit. Then, a weak electrical current was supplied to the thermal fuse 101 to determine whether the thermal fuse 101 is blown, by monitoring of the current flowing in the thermal fuse. With such a test, a period of time until the thermal fuse opens (blown) (thermal fuse operation time) can be measured. Further, power is continuously supplied to the heater even when the thermal fuse was blown. Thus, a period of time until the heater is cracked (heater-crack-time) can be also measured. From the present test, it can be seen that a crack of the heater does not occur at the time of the abnormal temperature rise when the heater-crack-time is longer than the thermal fuse operation time. A result of the abnormal temperature rise test in the present exemplary embodiment is illustrated in Table 1.

TABLE 1

| Number of Times | Heater-crack-time | Fuse operation time |
|---|---|---|
| First time | 13.70 seconds | 7.30 seconds |
| Second time | 13.80 seconds | 7.52 seconds |
| Third time | 14.40 seconds | 7.86 seconds |

The tests were conducted three times. In each time, a thermal fuse opened before a crack of the heater 11 occurred. Also, in each time, the heater-crack-time is equal to or longer than 13 seconds.

Figure 6A:
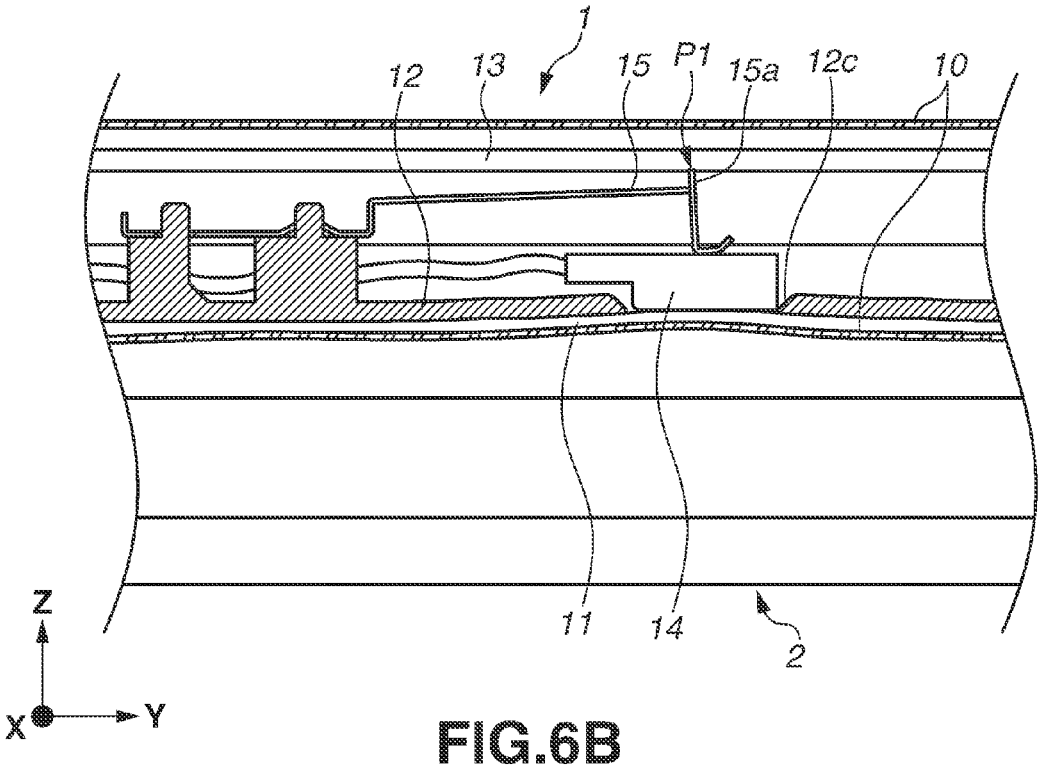
FIGS. 6A and 6B are sectional views illustrating a state after an abnormal temperature rise test.
Figure 6B:
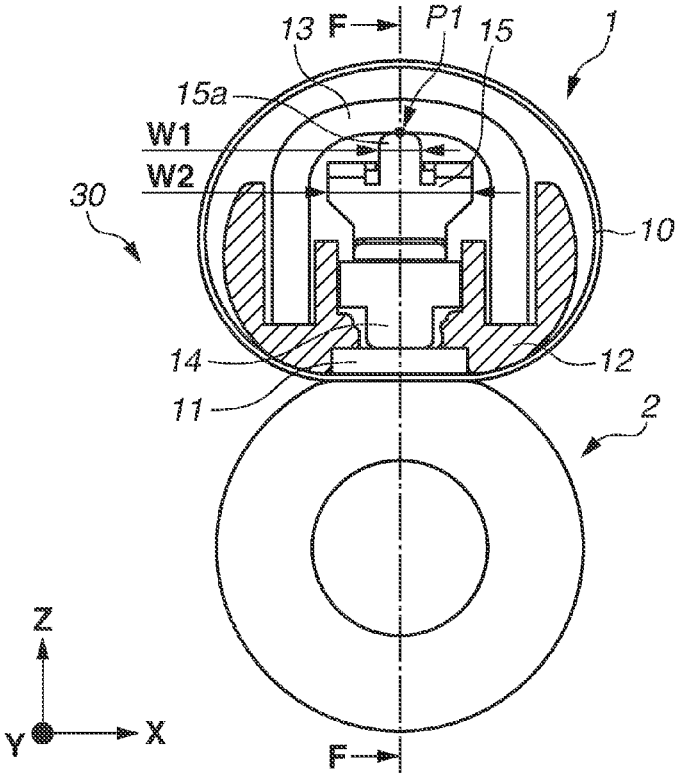

A schematic sectional view in a vicinity of the thermistor 14*a* when the abnormal temperature rise test in the present example was conducted is illustrated in each of FIGS. 6A and 6B. FIG. 6A is a sectional view along F-F in FIG. 6B. When the abnormal temperature rise test was conducted, the resin holder 12 having a low melting point melted. Along with the melting, the heater 11 is deformed under the pressure force from the pressure roller 2. Specifically, a part near the through-hole 12*c* into which the thermistor unit 14 is inserted is easily melted (easily become softened). Thus, strength of the holder 12 is decreased and a deformation amount of the heater 11 is increased. As a result, mechanical stress concentrates on the vicinity of a portion where the thermistor unit 14 of the heater 11 abuts. However, when the heater 11 is deformed by an amount of the gap G1, the projection portion 15*a* abuts on a position P1 of the stay 13. Thus, deformation of the heater 11 can be restricted. Also, in the longitudinal direction of the heater, the projection portion 15*a* is provided in a region where the thermistor unit 14 is provided. In the present example, the position of the projection portion 15*a* is placed in the longitudinal direction of the heater where the spring 15 presses the thermistor unit 14. Thus, the vicinity of the projection portion 15*a* of the spring 15 has high stiffness and can regulate a movement of the thermistor unit 14.

Figure 7A:
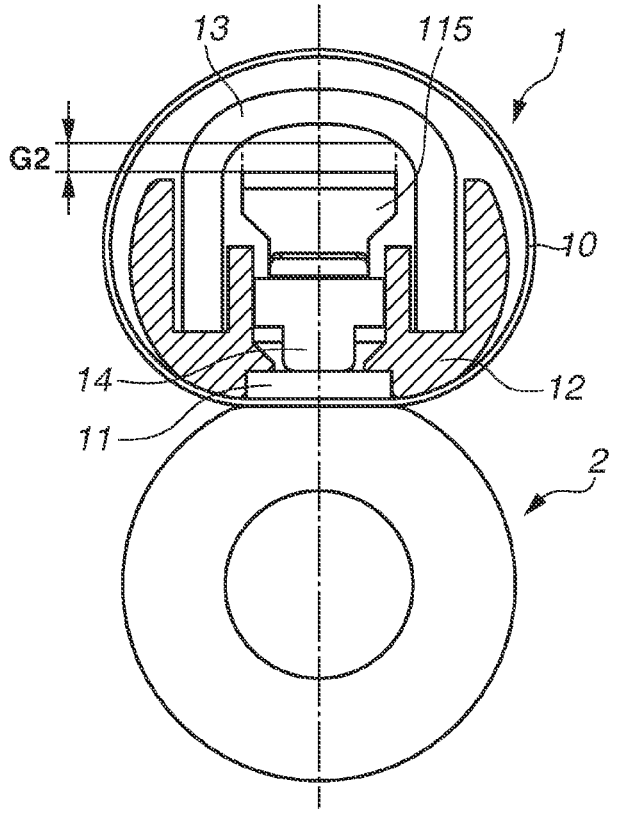
FIGS. 7A and 7B are sectional views of a fixing device of a comparison example.
Figure 7B:
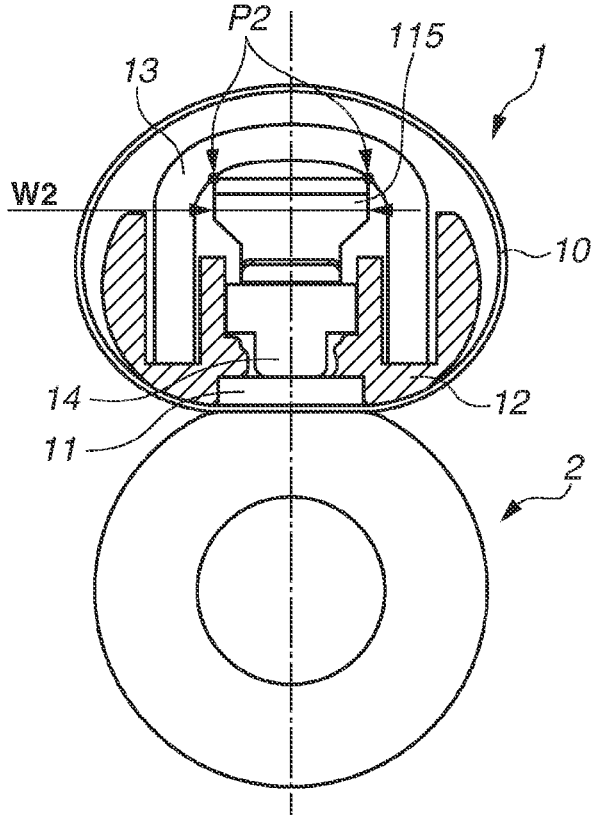

Next, a result of a test in a device of a comparison example having a spring 115 which is provided with no projection portion will be described. FIG. 7A is a sectional view illustrating a state in a normal operation and FIG. 7B is a sectional view illustrating a state in which a temperature rises abnormally. A fixing device in the comparison example is different from that in the exemplary embodiment only in a shape of the spring 115. A gap G2 between the spring 115 and a stay 13 of the comparison example is 1.4 mm. A result of the abnormal temperature rise test of the comparison example is illustrated in Table 2.

TABLE 2

| Number of Times | Heater-crack-time | Fuse operation time |
|---|---|---|
| First time | 11.60 seconds | 7.76 seconds |
| Second time | 8.94 seconds | 7.88 seconds |
| Third time | 10.10 seconds | 7.90 seconds |

The tests were conducted three times. In each time, a thermal fuse was blown before a crack in a heater 11 was generated. However, the heater-crack-time was 8.94 seconds to 11.60 seconds and was shorter than that in the exemplary embodiment. Also, there was a larger variation in the heater-crack-time and a difference from the fuse operation time was decreased. When the abnormal temperature rise test was conducted in the comparison example, the heater 11 was deformed and a spring 115 abutted on a position P2 in the stay 13 similar to the present exemplary embodiment, as illustrated in FIG. 7B. However, the gap G2 in the comparison example was 1.4 mm and larger than the gap G1 (0.8 mm) in the present exemplary embodiment. Thus, a deformation amount of the heater 11 becomes larger and the heater-crack-time becomes shorter.

Further, the stay 13 is arranged in a circular shape to prevent it from touching an inner surface of the film 10. Then, as illustrated in FIG. 6B, a width W1 of the projection portion 15*a* of the present exemplary embodiment is narrower than a full width of a pressure spring 15 (width of body part 15*b*) W2. Thus, the projection portion 15*a* can abut on a region (position P1) which is at a center part in an X-axis direction of the stay 13 and which has a small curvature. That is, an influence on the gap G1 is small even when there is a variation in a width W1 of a component. On the other hand, as illustrated in FIG. 7B, the spring 115 of the comparison example abuts on a region (position P2) in the stay 13 where a curvature is large. That is, when there is a variation in a width W2 of a component, it largely influences the gap G2 and also the heater-crack-time varies when the temperature abnormally rises.

As described above, it is possible to set the gap G1 small and to make the heater-cracked-time longer by providing the projection portion 15*a*. Further, by making the width W1 of the projection portion 15*a* narrower than the width W2 of the body part 15*b*, a movement width in a Z-axis direction of the thermistor unit 14 at the time of the abnormal temperature rise becomes more accurate and a heater crack is prevented more accurately.

Figure 8A:
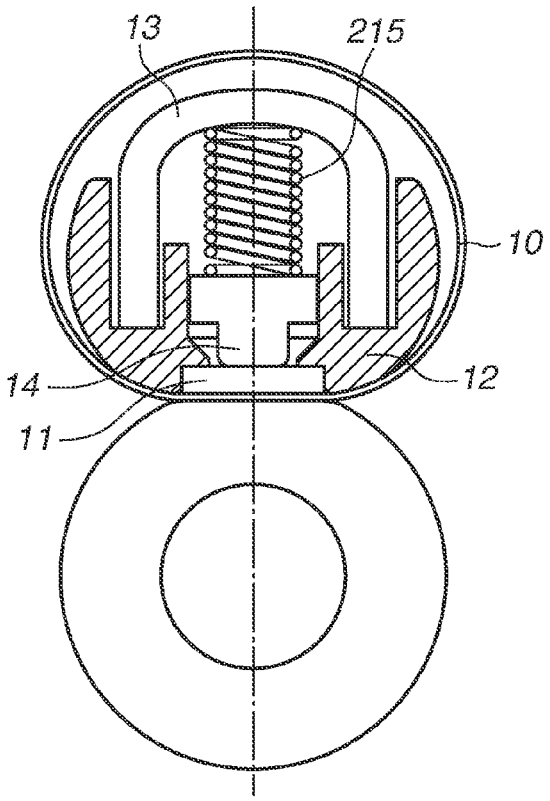
FIGS. 8A and 8B are sectional views of a fixing device of a comparison example.
Figure 8B:
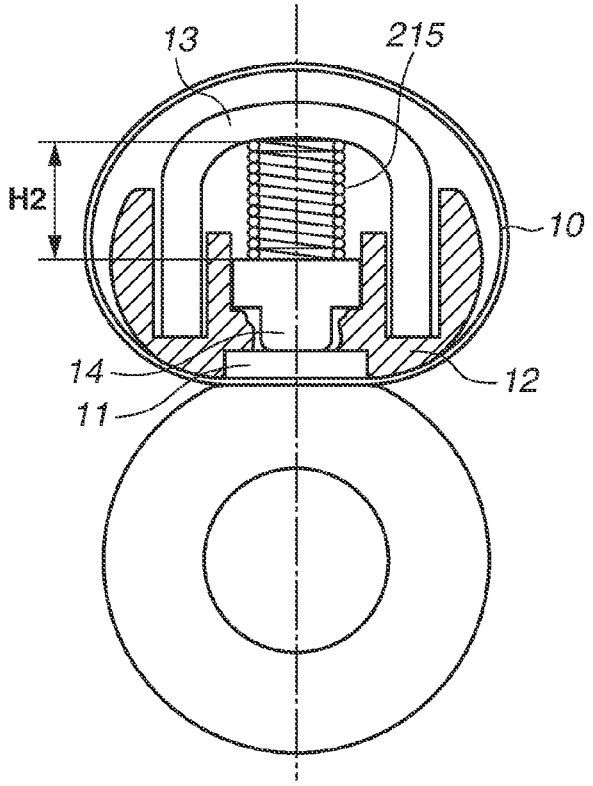

As a configuration to push a thermistor unit 14, a configuration in which a compression coil spring 215 is arranged between a stay 13 and a thermistor unit 14, is conceivable, for example, as illustrated in FIGS. 8A and 8B. FIG. 8A is a sectional view illustrating a state of a normal operation and FIG. 8B is a sectional view illustrating a state in which a temperature rises abnormally. In this configuration, as illustrated in FIG. 8B, when a heater 11 is deformed at the time of an abnormal temperature rise, the compression coil spring 215 shrinks to a compression limit, which restricts a movement of the thermistor unit 14. However, when the compression reaches its limit, a height H2 of the compression coil spring 215 greatly varies under an influence of a variation in the number of windings of a spring or an influence of a tolerance in a diameter of the spring. Thus, a stop position of the thermistor unit 14 when the heater is deflected due to the abnormal temperature rise is not accurate. On the other hand, since a plate spring is used in the present exemplary embodiment, a height H1 is accurate and a stop position of the thermistor unit 14 when the heater is deflected due to the abnormal temperature rise is accurate in the present embodiment.

Further, as illustrated in FIG. 8A, the compression coil spring 215 is constantly in contact with the stay 13 even in a normal operation. Thus, heat of the heater 11 easily moves to the stay 13 through the thermistor unit 14 and the compression coil spring 215. Since the stay 13 is made from metal, the stay 13 shows high thermal conductivity and, a large volume is necessary to improve stiffness. Therefore, the stay 13 has large heat capacity, so that the heat of the heater easily moves to the stay 13 and a temperature of a part where the heater 11 abuts on the thermistor unit is easily decreased. As a result, defective fixing of a toner image on a recording material easily occurs. On the other hand, in the present exemplary embodiment, the projection portion 15*a* of the spring 15 is not in contact with the stay 13 during a normal operation and there is an advantage that heat hardly moves.

In the exemplary embodiment, the thermistor unit 14 including a temperature detection element (thermistor 14*a*) has been described as a thermosensitive member. However, a projection portion described in the present example may be provided in a biasing member which biases, toward a heater, a protection element (element including switch portion) such as a thermal fuse or a thermo switch as a thermosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-250413, filed Dec. 10, 2014, which is hereby incorporated by reference herein in its entirety.

What is claimed is:

1. A fixing device configured to thermally fix an unfixed image formed on a recording material to the recording material, the fixing device comprising:

an elongated heater;

a holder formed from a thermoplastic resin which holds the heater in a longitudinal direction of the heater;

a reinforcing member which is in contact with the holder in the longitudinal direction and which reinforces the holder;

a thermosensitive member which is provided in a space between the holder and the reinforcing member and which receives heat from the heater through a through-hole provided in the holder; and a biasing member which biases the thermosensitive member toward the heater, wherein the biasing member includes a projection portion which is projected in a direction opposite to a direction biased by the biasing member, from a body part of the biasing member, and wherein the projection portion is not in contact with the reinforcing member when the device is operating normally, and the projection portion contacts the reinforcing member, regulates a movement of the thermosensitive member, and restricts deflection of the heater when the holder becomes softened and the heater is deflected.

2. The fixing device according to claim 1, wherein the biasing member is a plate spring and the projection portion is formed by folding of a part of the plate spring.

3. The fixing device according to claim 1, wherein a width of the projection portion is narrower than a width of the body part.

4. The fixing device according to claim 1, wherein the projection portion is provided in the longitudinal direction, in a region where the thermosensitive member is provided.

5. The fixing device according to claim 1, further comprising a tubular film, the heater being in contact with an inner surface of the film.

6. The fixing device according to claim 1, wherein the thermosensitive member includes a temperature detection element and the heater is controlled according to a temperature detected by the temperature detection element.

* * * * *